US008944177B2

(12) United States Patent
Guynn

(10) Patent No.: US 8,944,177 B2
(45) Date of Patent: Feb. 3, 2015

(54) SCRAPER WITH LATERAL TILT

(76) Inventor: Louis E. Guynn, Mt. Auburn, IA (US)

( * ) Notice: Subject to any disclaimer, the term of this patent is extended or adjusted under 35 U.S.C. 154(b) by 397 days.

(21) Appl. No.: 13/109,475

(22) Filed: May 17, 2011

(65) Prior Publication Data

US 2012/0291320 A1 Nov. 22, 2012

(51) Int. Cl.
*E02F 3/76* (2006.01)
*E02F 3/65* (2006.01)

(52) U.S. Cl.
CPC ..... *E02F 3/658* (2013.01)
USPC ..... 172/799.5; 172/4.5

(58) Field of Classification Search
USPC ..... 37/428; 172/780, 781, 783, 795–799.5, 172/818, 819–824, 2, 4.5
See application file for complete search history.

(56) References Cited

U.S. PATENT DOCUMENTS 1,982,219 A * 11/1934 McAlister ..... 172/799.5
2,051,283 A * 8/1936 Austin ..... 172/799.5
2,078,501 A * 4/1937 Maloon ..... 172/799.5
3,097,440 A * 7/1963 Schmidt ..... 37/428
3,430,366 A * 3/1969 King ..... 37/428
3,561,538 A * 2/1971 Curlett et al. ..... 172/4.5
3,776,318 A * 12/1973 Layton ..... 172/777
4,031,964 A * 6/1977 Takahashi et al. ..... 172/9
4,055,222 A * 10/1977 Runte ..... 172/799.5
4,105,078 A * 8/1978 Gilbert ..... 172/781
4,299,290 A * 11/1981 Nunes, Jr. ..... 172/4.5
4,898,247 A * 2/1990 Springfield ..... 172/799.5
5,235,511 A * 8/1993 Middleton et al. ..... 701/50
5,560,431 A * 10/1996 Stratton ..... 172/2
6,269,885 B1 * 8/2001 Barber et al. ..... 172/7
7,284,346 B2 * 10/2007 Miskin ..... 37/416
7,458,428 B2 12/2008 Laudick et al.
8,083,004 B2 * 12/2011 Knight, Jr. ..... 172/7
8,141,650 B2 * 3/2012 Breiner et al. ..... 172/4.5
8,145,391 B2 * 3/2012 Omelchenko et al. ..... 701/50
8,418,777 B1 * 4/2013 Grossen ..... 172/820
8,634,991 B2 * 1/2014 Douglas ..... 701/50
8,726,543 B2 * 5/2014 Kelly ..... 37/412
2006/0042804 A1 * 3/2006 Pecchio ..... 172/4.5
2007/0125557 A1 * 6/2007 Pecchio ..... 172/4.5
2008/0047170 A1 * 2/2008 Nichols ..... 37/348

* cited by examiner

*Primary Examiner* — Thomas B Will
*Assistant Examiner* — Joan D Misa
(74) *Attorney, Agent, or Firm* — Zarley Law Firm, P.L.C.

(57) ABSTRACT

A scraper that has a frame that supports wheels. The scraper includes a blade and a blade height and tilt assembly that are connected to the frame in order to both adjust the height of the blade and the angle at which the blade cuts soil.

16 Claims, 4 Drawing Sheets

SCRAPER WITH LATERAL TILT

BACKGROUND OF THE INVENTION

This invention relates to scrapers. More specifically, this invention relates to a scraper with a blade that is both height adjustable and tiltable.

Towed scrapers have been utilized for many years to cut top layers of soil in order to excavate waterways and the like. When making a waterway great care is exhibited to ensure the bottom surface is level. When the bottom surface is angled or curved a bottom base point is formed. Water pressure then acts on this bottom base point to form undesired crevices in the waterway.

A typical scraper can be seen in U.S. Pat. No. 7,458,428 to Laudick et al., a reference that is incorporated herein. While current scrapers such as the scraper taught by Laudick are used to scrape soil from the earth, problems remain. Specifically, while the height of the blade may be adjusted for different grades of cuts, oftentimes the angle of the blade needs to be tilted to provide more aggressive cuts. Further, a controller needs to be able to control the blade and provide information regarding the blade to provide more precision during the scraping process.

Thus, a principal object of the present invention is to provide a scraper with a tiltable blade.

Yet another object of the present invention is to provide a scraper that provides enhanced scraping abilities allowing more precise excavating to occur.

These and other objects, features, and advantages will become apparent from the specification and claims.

BRIEF SUMMARY OF THE INVENTION

A scraper having a frame that supports a plurality of wheels. A blade is mounted to the frame and has a blade that is adjustable via a blade height and tilt assembly. The blade height and a tilt assembly adjustably raises, lowers and tilts the angle of the blade.

DETAILED DESCRIPTION OF THE PREFERRED EMBODIMENT

Figure 1:
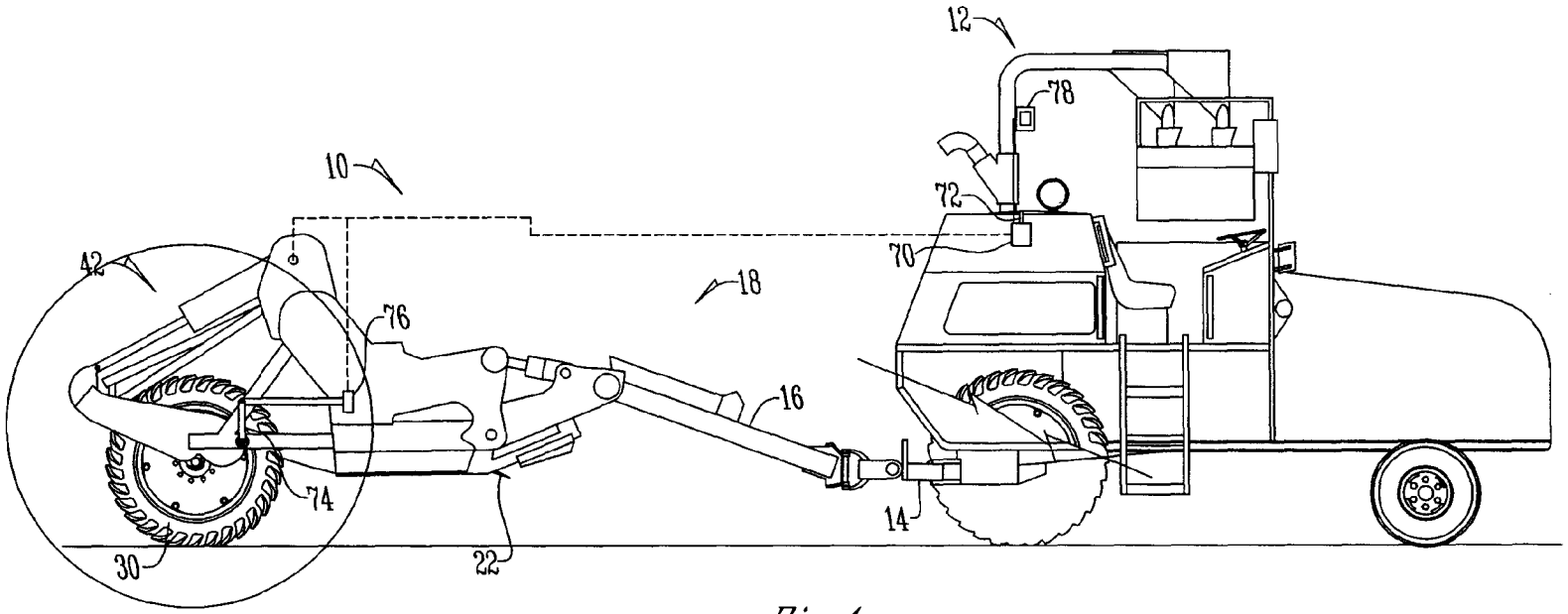
FIG. 1 is a side plan view of a scraper.
Figure 2:
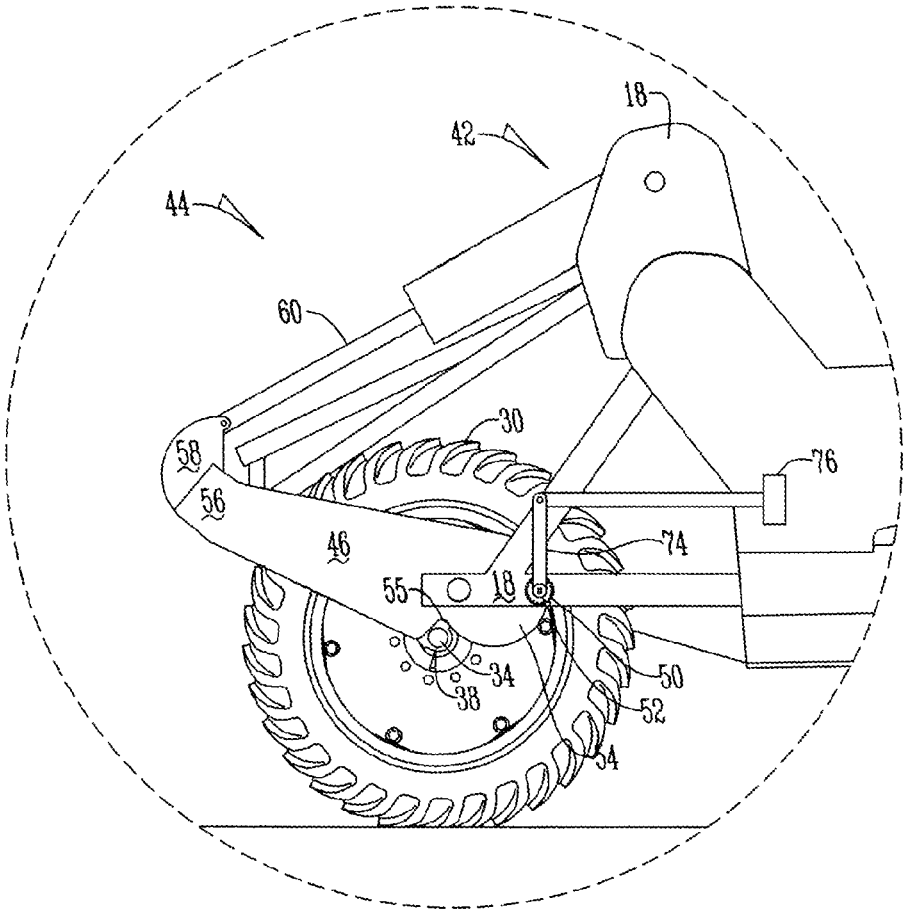
FIG. 2 is a side perspective view of a blade tilt assembly for a scraper.

FIG. 1 shows a scraper 10 being towed by a vehicle such as a tractor 12 that has a draw bar 14 that connects to the tongue 16 of the scraper 10. The scraper 10 has a frame 18 that includes tongue 16 where a blade 22 is mounted to the frame 18. The blade scrapes dirt from the ground into a hopper (not shown) as is known in the art. Additionally attached to the frame are first and second wheels 30 that each has their own axle 34 that include nut elements 38. As best seen in FIG. 2, a blade height and tilt assembly 42 is connected to the frame 18 to adjustably tilt frame 18 in order to change the angle of the blade 22. The blade tilt assembly 42 has first and second sets of arm brackets 44 and 45. As best seen in FIG. 2, with reference to only the first arm bracket 44, the bracket 44 has first and second arm elements 46 and 48 that are in spaced relation with their respective wheel 30 disposed therebetween.

The first and second arm elements 46 and 48 are pivotably mounted to the frame 18 at pivot points 50 that rotate the arms 46 and 48 about a pivot axis 52. Adjacent the pivot point 50 at a first end 54, each arm element 46 and 48 has a notch 55 disposed therein that is of size and shape to receive a nut element 38 of an axle 34. In this manner, when pivoted, the notch 55 of the arm elements 46 and 48 engage the nut elements 38 of a wheel 30 causing the frame 18 and thus blade 22 to lift.

Each of the arm elements 46 and 48 extend from a first end 54 to a second end 56 and at the second end 56 the arm elements 46 and 48 are secured to an attachment mechanism 58 that spans between the first and second arm elements 46 and 48. Pivotably connected to the attachment mechanism 58 is an actuating device 60 that in a preferred embodiment is a hydraulic device. The actuating device 60 is secured to the frame 18 and is utilized to rotate the arm elements 46 and 48 about the pivot axis 52.

Figure 3:
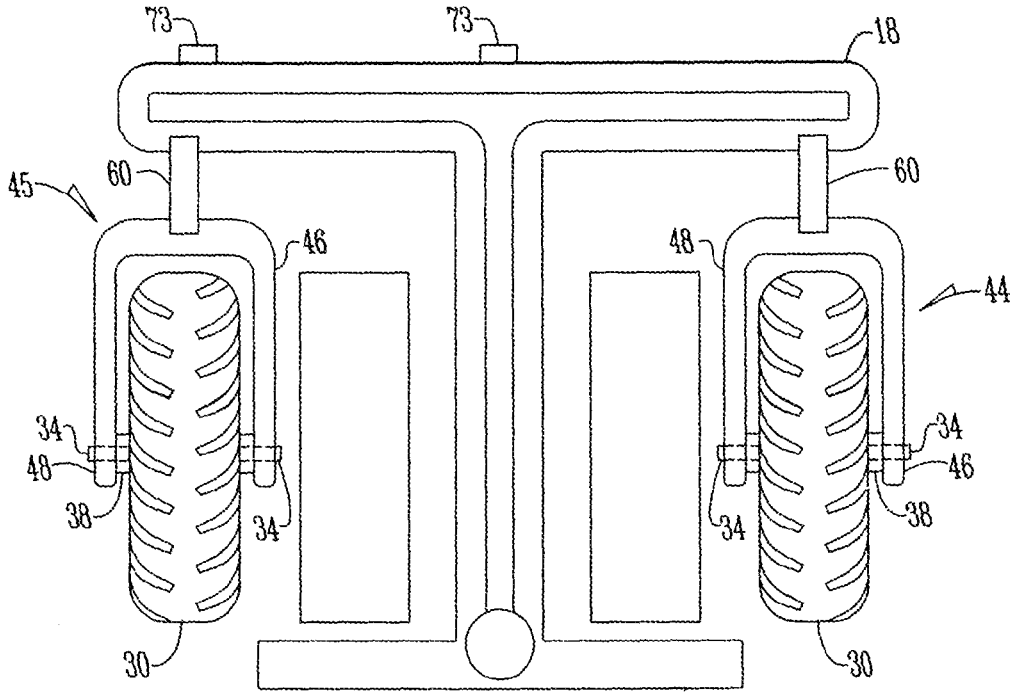
FIG. 3 is an end plan view of a scraper.

In the embodiment of FIGS. 2 and 3 the connection point between the attachment mechanism 58 and the actuating device 60 is a pivotable connection and the connection between the actuating device 60 and the frame 18 is a fixed or static connection. In alternative embodiments a pivotal connection at the frame 18 or a fixed connection at the attached mechanism 58 by the actuating device 60 are presented without falling outside the scope of this disclosure.

Figure 4:
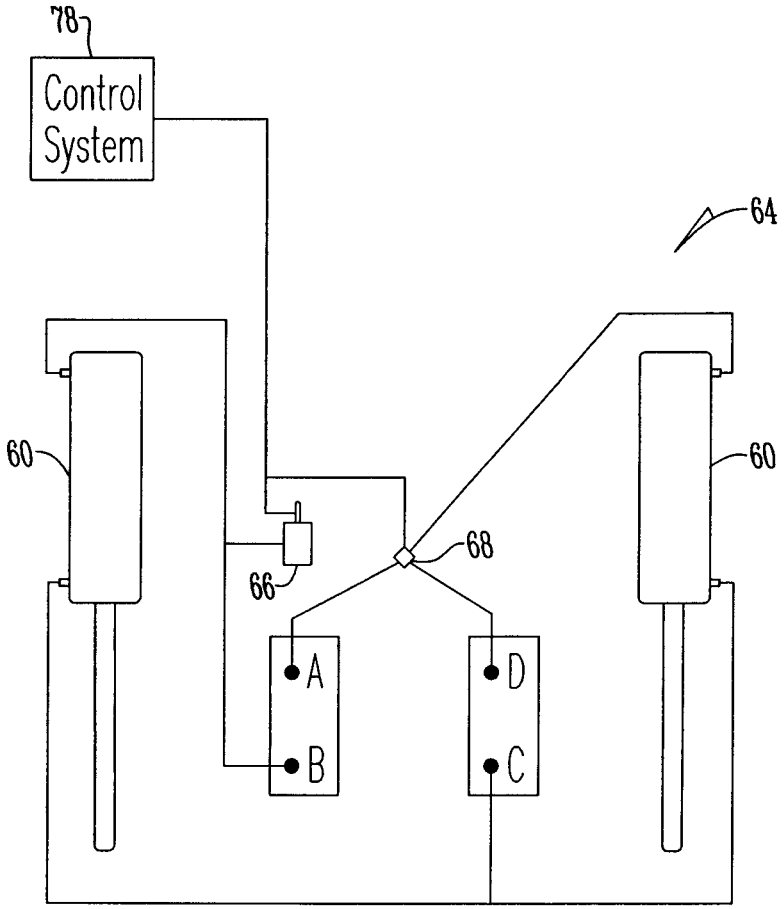
FIG. 4 is schematic diagram of a hydraulic system of a scraper.

In a preferred embodiment, as discussed above, the actuating device 60 is a hydraulic device where both the first and second sets of arm brackets 44 and 45 are controlled by an actuating device 60 that is a hydraulic device. In such a system, as shown in FIG. 4, a hydraulic system 64 is presented that fluidly connects the actuating device 60 of the first arm bracket set 44 with the actuating device 60 of the second arm bracket set 45. In such a system an electric solenoid valve 66 and T-valve 68 are provided and are electrically connected to a control system 70 that controls operation of the valves.

In this arrangement the hydraulic cylinders of the actuating devices 60 begin at a mid stroke position. When the solenoid valve 66 is opened hydraulic fluid flows from C through the solenoid valve 66 to D to stroke a first actuator device 60 to lower the first arm bracket set 44. In contrast, when the hydraulic fluid within the system flows in the opposite direction and goes from D to C the arm bracket set 44 raises.

Meanwhile, when the solenoid valve 66 is closed fluid flows from A to B raises the second arm bracket 45. When the fluid flows in the opposite direction from B to A the second bracket set 45 raises. In this manner, the hydraulic system 64 can independently raise and lower the first and second arm bracket sets 44 and 45 depending on the desired control of a user to provide the desired tilt of the blade 22.

The control system 70 is programmed in order to actuate the first and second sets of arm brackets 44 and 45 in order to tilt the frame 18 and thus blade 22 of the scraper 10. The control system 70 in one embodiment utilizes a global positioning system (GPS) 72 in order to program the control system 70 to determine the proper actuation of the sets of arm brackets 44 and 45. Antennas 73 may be placed on the frame 18 in order to transmit GPS information to the GPS 72 and control system 70. In a preferred embodiment two antennas are utilized where one is positioned on a middle section of the frame 18 to measure the height of the blade 22 and a second antenna 73 is at a side of the frame 18 to measure the tilt of the blade 22. In and alternative embodiment a laser is used to transmit and detect information instead of the GPS 72 to operate the control system 70.

In one embodiment a detection rod 74 is placed on the pivot point 50 to rotate simultaneously with the sets of arm elements 44 and 45 such that a linear motion detector 76 is secured to the frame 18 and attached to the rod 74 to gather information regarding tilt or angle of the arms 46 and 48. Specifically, the linear motion detector 76 is electrically connected to the control system 70 to transmit such information and data to the control system 70 so that the information is presented on a display 78 in the cab of the vehicle 12.

In operation, as the scraper 10 transverses across an area to be scraped, the blade 22 scrapes the soil from the ground. When the blade is desired to be lowered the blade height and tilt assembly 42 is actuated in order to simultaneously raise or lower the first and second sets of arm brackets 44 and 45 to determine the height of the blade 22. Then, when a user decides to tilt the blade to provide a steeper angle for the blade 22 the user using the control system 70 actuates the actuating devices 60 to independently move the first and second sets of arm brackets 44 and 45. Depending on the desired positioning of the blade 22 each of the sets of arm brackets 44 and 45 are either raised or lowered individually thus rotating the sets of arms 44 and 45 around a pivot axis 52 about a pivot point 50. When the arms 46 and 48 engage a nut element 38 of a wheel 30 the frame 18 is lifted affecting the tilt of the blade 22. The control system 70 simultaneously receives tilt information from the linear motion detector 76 to provide tilt information on the display 78 to the user.

Thus provided is a scraper that has an adjustable blade height and tilt assembly 42. By allowing the user to control the tilt of the blade 22 the user may decide to more aggressively scrape soil using a steeper angle of the blade 22. By utilizing in a preferred embodiment a hydraulic system 64, independent actuation of actuating devices 60 can be accomplished thus again providing more control, more precision and an improved scraper 10. In addition, the control system 70 utilizes a GPS 72 laser or other means in order to assist with the actuation of the actuating devices 60 by the control system 70. Further, a linear motion detector 76 is utilized to provide on a display 78 the exact tilting of blade to ensure precise scraping is presented. Thus, at the very least all of the stated objectives have been met.

It will be appreciated by those skilled in the art that other various modifications could be made to the device without departing from the spirit and scope of this invention. All such modifications and changes fall within the scope of the claims and are intended to be covered thereby.

What is claimed is:

1. A scraper comprising:

a frame supporting a plurality of wheels;

a blade mounted to the frame;

a blade height and tilt assembly connected to the frame and having a first set of arm brackets comprising a pair of arms in spaced relation and connected to a first wheel and a second set of arm brackets comprising a pair of arms in spaced relation and connected to a second wheel, wherein the first set of arm brackets and the second set of arm brackets are positioned in spaced alignment to one another;

a first actuator connected to the frame and the first set of arm brackets, and a second actuator connected to the frame and the second set of arm brackets;

the first set of arm brackets and second set of arm brackets have a first end and a second end, the first set of arm brackets pivotally connected to the frame adjacent the first end and pivotally connected to the first actuator adjacent the second end;

the second set of arm brackets pivotally connected to the frame adjacent the first end and pivotally connected to the second actuator adjacent the second end; and a control system connected to the first actuator and the second actuator, a first antenna mounted to the frame to measure a height of the blade, and a second antenna mounted to the frame to measure the tilt of the blade the first antenna and second antenna configured to transmit GPS signals to the control system such that the control system actuates the first actuator and the second actuator based upon the measured height and tilt of the blade to raise and lower the height of the blade and to adjustably tilt the blade to varying angles.

2. The scraper of claim 1 further comprising a first detection rod connected to the first set of arm brackets and a second detection rod connected to the second set of arm brackets wherein the first detection rod and the second detection rod gather information regarding tilt or angle of the blade.

3. The scraper of claim 2 wherein the first detection rod rotates simultaneously with the first set of arm brackets and the second detection rod rotates simultaneously with the second set of arm brackets.

4. The scraper of claim 1 further comprising a first detection rod and a first linear motion detector connected to the first set of arm brackets and a second linear motion detector and a second detection rod connected to the second set of arm brackets wherein the first linear motion detector and the second linear motion detector gather information regarding tilt or angle of the blade, wherein an attachment mechanism is pivotably connected to the first and second actuating devices for pivoting the first and second arms about the pivot axis.

5. The scraper of claim 4 wherein the first detection rod rotates simultaneously with the first set of arm brackets and the second detection rod rotates simultaneously with the second set of arm brackets first actuator and the second actuator.

6. The scraper of claim 1 wherein the first actuator and the second actuator are electrically connected to the control system that actuates the first actuator and the second actuator independently to tilt the blade.

7. The scraper of claim 6 wherein the control system has a global positioning system that controls the movement of the first actuator and the second actuator.

8. The scraper of claim 6 wherein the first actuator and second actuator are hydraulic actuators that are fluidly connected to a hydraulic system.

9. The scraper of claim 1 wherein a tilt rod is pivotably connected to one of the first set of arm brackets or the second set of arm brackets and is in communication with a linear motion detector that is electrically connected to the control system to monitor the tilt of the blade.

10. The scraper of claim 1 wherein the first antenna and the second antenna on the frame and are electrically connected to the control system to communicate information to a global positioning system.

11. The scraper of claim 1 wherein the control system is electrically connected to a laser generating and detecting device that communicates with the control system to actuate the blade height and tilt assembly.

12. The scraper of claim 1 wherein the first antenna is positioned on a middle section of the frame.

13. The scraper of claim 1 wherein the second antenna is positioned at a side section of the frame.

14. The scraper of claim 1 further comprising:

a notch positioned between the first end and the second end of the first set of arm brackets, wherein the notch receives a nut element connected to an axle of the first wheel; and a notch positioned between the first end and the second end of the second set of arm brackets, wherein the notch receives a nut element connected to an axel of the second wheel.

15. A scraper comprising:

a frame supporting a plurality of wheels;

a blade mounted to the frame;

a blade height and tilt assembly connected to the frame and having a first set of arm brackets comprising a pair of arms in spaced relation and connected to a first wheel and a second set of arm brackets comprising a pair of arms in spaced relation and connected to a second wheel, wherein the first set of arm brackets and the second set of arm brackets are positioned in spaced alignment to one another;

a first actuator connected to the frame and the first set of arm brackets, and a second actuator connected to the frame and the second set of arm brackets;

the first set of arm brackets and second set of arm brackets have a first end and a second end;

the first set of arm brackets pivotally connected to the frame adjacent the first end and pivotally connected to the first actuator adjacent the second end;

the second set of arm brackets are pivotally connected to the frame adjacent the first end and pivotally connected to the second actuator adjacent the second end;

a control system connected to the first actuator and the second actuator, a first antenna mounted to the frame to measure a height of the blade, and a second antenna mounted to the frame to measure the tilt of the blade, the first antenna and second antenna configured to transmit GPS signals to the control system such that the control system actuates the first actuator and the second actuator based upon the measured height and tilt of the blade to raise and lower the height of the blade and to adjustably tilt the blade to varying angles; and a first tilt rod connected to the first set of arm brackets and in communication with a first linear motion detector electrically connected to the control system to monitor the tilt of the blade, and a second tilt rod connected to the second set of arm brackets and in communication with a second linear motion detector electrically connected to the control system to monitor the tilt of the blade.

16. A scraper comprising:

a frame supporting a plurality of wheels;

a blade mounted to the frame;

a blade height and tilt assembly connected to the frame and having a first set of arm brackets comprising a pair of arms in spaced relation and connected to a first wheel and a second set of arm brackets comprising a pair of arms in spaced relation and connected to a second wheel, wherein the first set of arm brackets and the second set of arm brackets are positioned in spaced alignment to one another;

a first actuator connected to the frame and the first set of arm brackets, and a second actuator connected to the frame and the second set of arm brackets wherein the first actuator and the second actuator are hydraulic cylinders that begin at a mid-stroke position;

the first set of arm brackets and second set of arm brackets have a first end and a second end;

the first set of arm brackets are pivotally connected to the frame adjacent the first end and pivotally connected to the first actuator adjacent the second end;

the second set of arm brackets are pivotally connected to the frame adjacent the first end and pivotally connected to the second actuator adjacent the second end;

a hydraulic system connected to the first actuator and the second actuator, the hydraulic system having an electric solenoid and a T-valve that independently controls the first actuator and the second actuator;

a control system connected to the first actuator and the second actuator, a first antenna mounted to the frame to measure a height of the blade, and a second antenna mounted to the frame to measure the tilt of the blade, the first antenna and second antenna configured to transmit GPS signals to the control system such that the control system actuates the first actuator and the second actuator based upon the measured height and tilt of the blade to raise and lower the height of the blade and to adjustably tilt the blade to varying angles; and the control system connected to the solenoid and the T-valve such that the control system actuates the actuators based upon the measured height and tilt of the blade to raise and lower the height of the blade and to adjustably tilt the blade to varying angles.

* * * * *